US006575587B2

(12) United States Patent
Cramer et al.

(10) Patent No.: US 6,575,587 B2
(45) Date of Patent: Jun. 10, 2003

(54) LIGHT WITH CLAMP THAT FITS INTO A HEADBAND

(75) Inventors: Steven M. Cramer, Park City, KS (US); Keith Skidmore, Newton, KS (US); Kelly Merl Wright, Wichita, KS (US); Gary Israel, Andover, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 09/915,627

(22) Filed: Jul. 26, 2001

(65) Prior Publication Data

US 2003/0021105 A1 Jan. 30, 2003

(51) Int. Cl.[7] ..... F21V 21/084
(52) U.S. Cl. ..... 362/105; 362/191; 362/396
(58) Field of Search ..... 362/103, 105, 362/106, 191, 108, 396, 171, 177, 427

(56) References Cited

U.S. PATENT DOCUMENTS

| | | | | |
|---|---|---|---|---|
| 1,262,065 A | | 4/1918 | Lee | |
| 1,294,752 A | | 2/1919 | Ballard | |
| 3,828,201 A | | 8/1974 | Allen, Sr. | |
| 4,249,233 A | | 2/1981 | Gatton | |
| 4,298,913 A | * | 11/1981 | Lozar | 362/103 |
| 4,400,763 A | * | 8/1983 | Kribs et al. | 362/103 |
| 4,417,299 A | * | 11/1983 | Rupp | 362/109 |
| 4,429,351 A | | 1/1984 | Petzl et al. | |
| 4,631,644 A | | 12/1986 | Dannhauer | |
| 4,734,834 A | | 3/1988 | Petzl et al. | |
| 4,967,323 A | | 10/1990 | Johnson et al. | |
| 5,115,382 A | | 5/1992 | Smith | |
| 5,660,460 A | | 8/1997 | McLeod, Jr. | |
| 5,800,042 A | | 9/1998 | Blank | |
| 6,012,827 A | | 1/2000 | Caplan et al. | |

* cited by examiner

*Primary Examiner*—Sandra O'Shea
*Assistant Examiner*—John Anthony Ward
(74) *Attorney, Agent, or Firm*—Leydig, Voit & Meyer, Ltd.

(57) ABSTRACT

A light that is mounted on a clamp. The clamp is configured to be attached to different locations on a user's body, and is sufficiently sturdy so that it can support the light in an illumination direction that is fixed relative to the user's body. The light is connected by a cord to a power supply, such as a battery pack or an AC adapter. If a battery pack is used, the battery pack may also include a mechanism, such as a clip, for attaching the battery pack to the clothing or belt of a user. A headband is provided to which the clamp may be attached. The light is pivotally attached to the clamp so the light may be pivoted to illuminate in a desired direction. In addition, the light is rotatably mounted on the clamp arm, permitting the light to illuminate in a wide variety of different angles.

27 Claims, 5 Drawing Sheets

LIGHT WITH CLAMP THAT FITS INTO A HEADBAND

FIELD OF THE INVENTION

The present invention relates generally to lights, and more particularly to portable lights.

BACKGROUND OF THE INVENTION

Active people often find themselves in need of a portable light source, such as while backpacking, performing auto maintenance, and spelunking, for example. Flashlights are most often used to provide the light source, especially where a power outlet is not readily available. Other options include handheld "drop" lights powered by extension cords, and cord or battery-powered lights that are fixed to portable floor stands.

Although flashlights work well for their intended purpose, they are often inconvenient in that a user must hold the light to direct it to suitable location, which may be difficult if the user needs both hands for performing work or other tasks. Alternatively, the user must find a suitable support where the light will correctly illuminate the work area. This solution is satisfactory only if the user desires for the focus of the light to remain fixed, and can be inconvenient if the user has to often adjust the direction of the light, or if the user needs illumination while moving.

The use of hand-held drop lights with extension cords has numerous possible disadvantages depending on the work situation. Some of the possible disadvantages include the inconvenience of manipulating the long and somewhat inflexible heavy cord, cords which are not always long enough to reach outlets, work areas where electric outlets are not available at all, and the lack of a suitable place to attach or lay the light so it will illuminate directly onto the work surface. Most of the possible disadvantages associated with drop lights may also be applicable to lights attached to portable floor stands.

In an attempt to solve some of the above stated problems, powered lamps have in the past been provided which are mountable to a person's head. The lamps may be attached to helmets, for example, or may be attached to straps that are worn around a user's head. The head-attachable lamps are convenient in that the light may be positioned to illuminate an area that the user wishes to see, usually straight out from the user's head. Head attachable lamps are also convenient in that they leave both of the user's hands free for performing tasks.

Although prior art head lamps work well to free a user's hands, there are problems associated with their use. Often, a user may be frustrated that the lamp illuminates only directly in front of the user's head. Guiding the light to a work area is equivalent to having to point the user's nose at the work area. This operation may not always be possible or comfortable, especially in crowded environments. In addition, there are many situations when a user may want light to focus from a direction other than from the top of the head, or may not have room to place the lamp on his or her head because of crowded work conditions. Moreover, some users may not want to wear anything at all on their heads because of the associated discomfort.

SUMMARY OF THE INVENTION

The present invention solves many problems of the prior art by providing a light that is mounted on a clamp. The clamp is configured to be attached to different locations on a user's body, and is sufficiently sturdy so that it can support the light in an illumination direction that is fixed relative to the user's body. To this end, the clamp includes a pair of arms that are spring-biased together, and which may be separated and clamped around clothing or a belt, for example. The bias of the spring sturdily holds the clamp, and therefore the light, in place on the clothing. The arms preferably have a substantial gripping surface area, and the light preferably does not extend too far from the clamp, so that the light does not droop or sag or rock when the clamp is attached to a surface. The clamp arms may include teeth that aid in securing the clamp to clothing and other items, and which further stabilize the light during illumination.

The light is connected by a cord to a power supply, such as a battery pack or an AC adapter. If a battery pack is used, the battery pack may also include a mechanism, such as a clip, for attaching the battery pack to the clothing or belt of a user. In this manner, the light and its power source may be easily transported during use.

In accordance with one aspect of the present invention, a headband is provided to which the clamp may be attached. To this end, in one embodiment, the headband includes a slot into which one of the arms of the clamp is fitted. The spring binds the other arm to the outside of a housing for the slot, to securely hold the light in place.

In accordance with another aspect of the present invention, the light is pivotally attached to the clamp so the light may be pivoted to illuminate in a desired direction. To this end, the light is mounted on a hinge that is attached to one leg of the clamp. In accordance with a further aspect of the present invention, the hinge may be rotatably mounted on the clamp arm, permitting the light to illuminate in a wide variety of different angles. In this manner, after the light is attached to a user, a user may manipulate the light toward a desired target, providing flexibility in illumination direction.

In accordance with still a further aspect of the present invention, the light includes a bezel, the rotation of which causes the light to turn off or on. The light may further be designed so that rotation of the bezel varies the light beam width.

Other advantages will become apparent from the following detailed description when taken in conjunction with the drawings, in which:

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well-known features may be omitted or simplified in order not to obscure the present invention.

Figure 1:
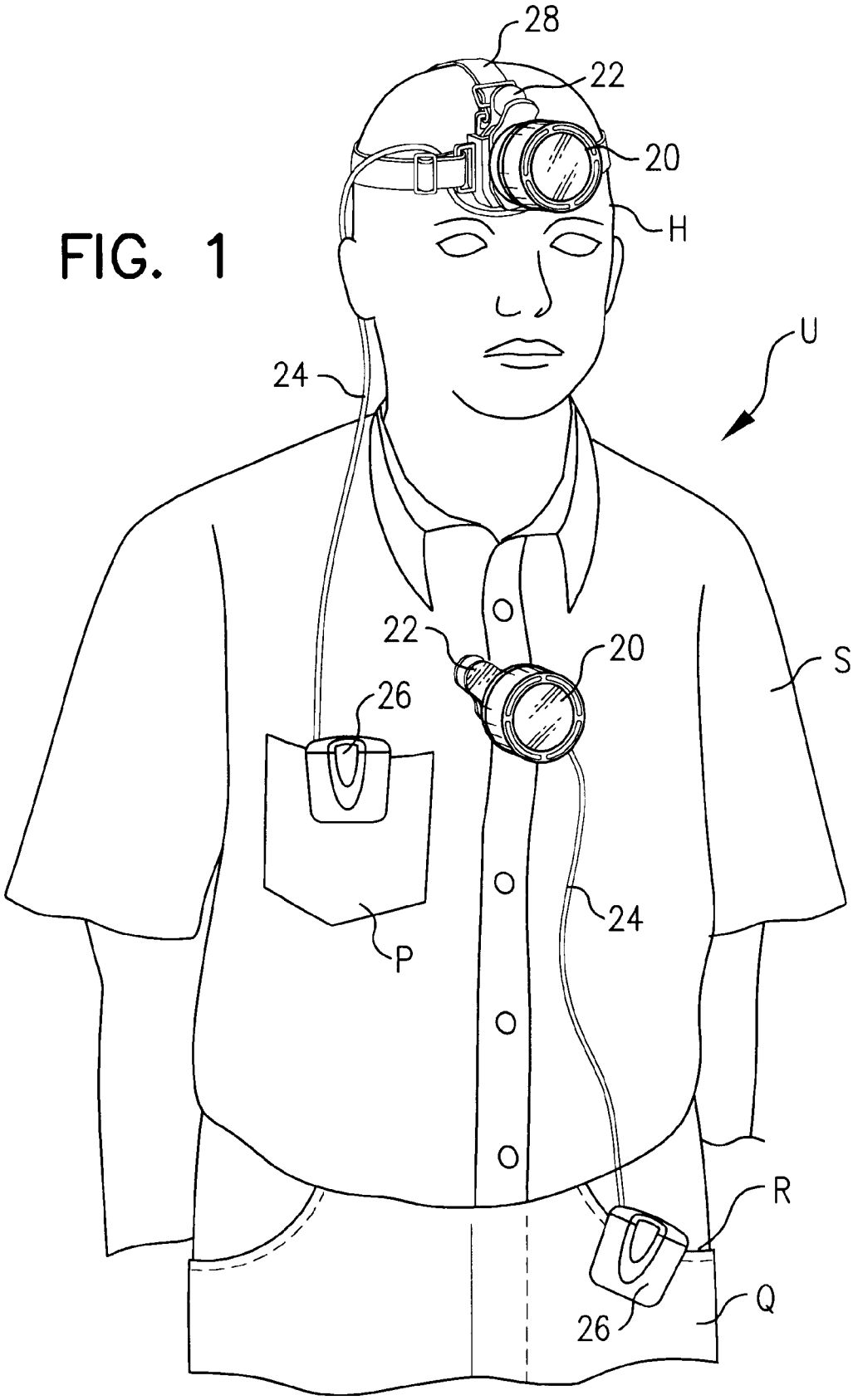
FIG. 1 is a front view of a person wearing two lights having clamps in accordance with the present invention, with a first light clamped to the shirt of the person, and a second light clamped to a headband worn by the person.
Figure 2:
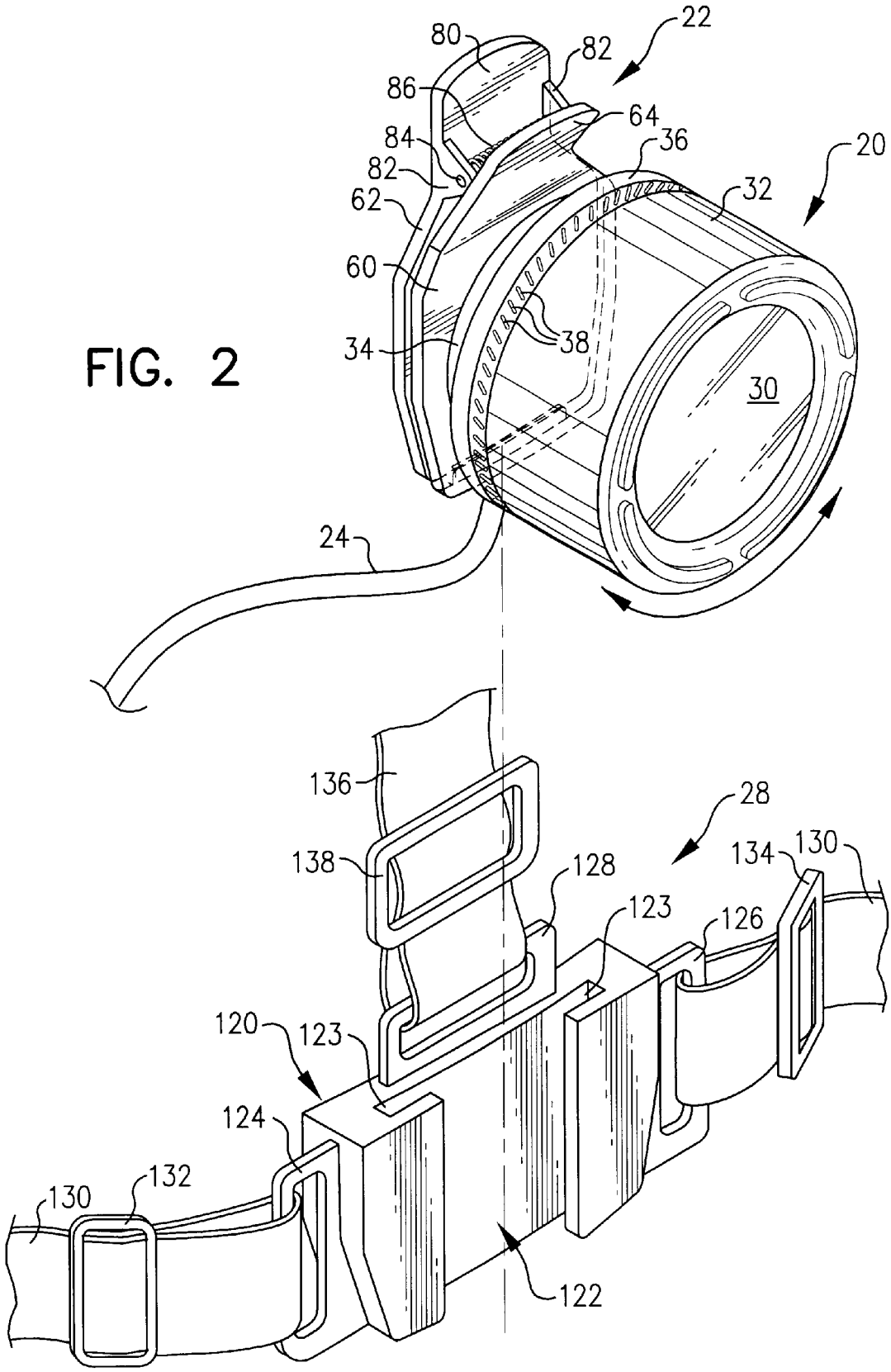
FIG. 2 is a side perspective view showing a light with a clamp in accordance with the present invention, showing attachment of the light to a headband.
Figure 3:
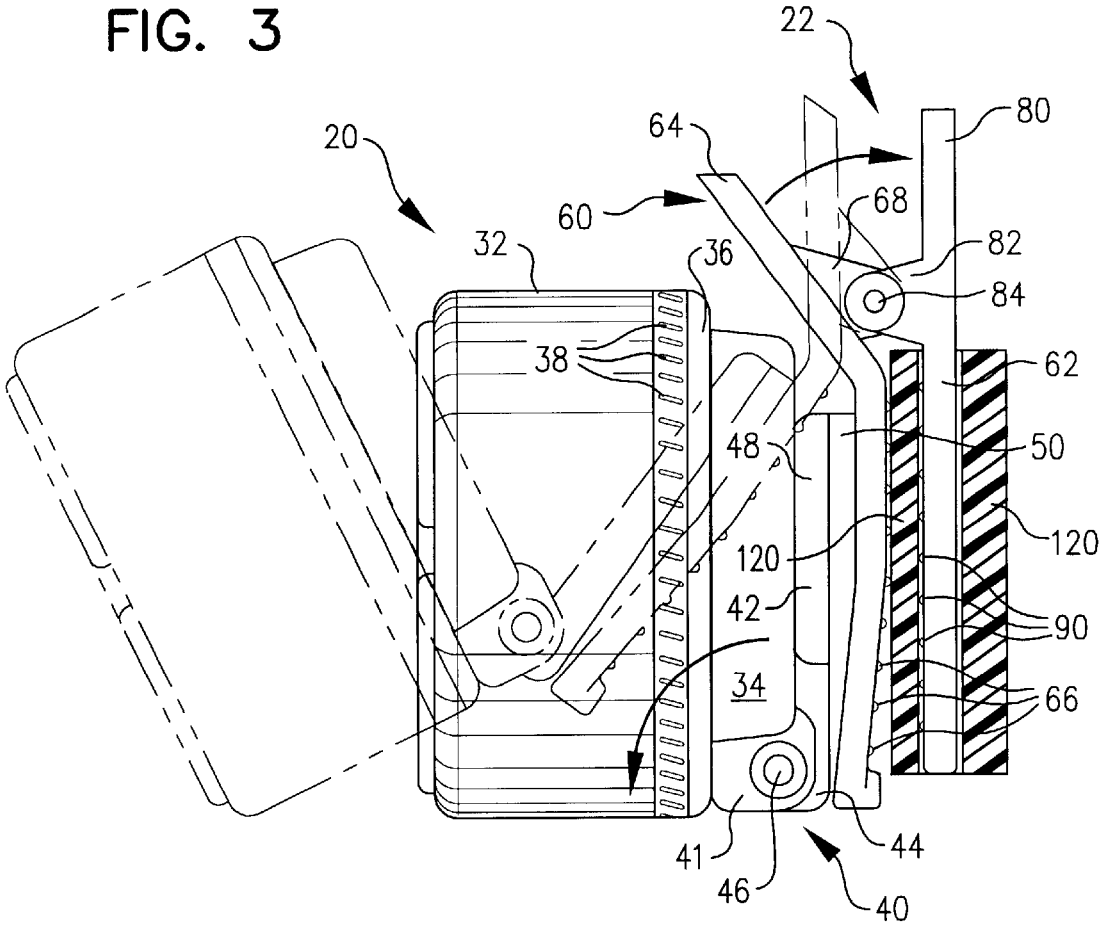
FIG. 3 is a side view of the light of FIG. 2, shown attached to the headband, and showing an opened position of the clamp, with the light hinged out from the clamp shown in phantom in accordance with one aspect of the present invention.

Briefly described, with reference to FIG. 1, the present invention provides a light 20 (two are shown in FIG. 1) mounted on a clamp 22 (best shown in FIGS. 2 and 3). The light 20 is connected to a cord 24, which in turn is connected to a power supply, in FIG. 1 a battery pack 26. The clamp 22 may be attached to clothing, a belt, or otherwise to a person, such as attached to a shirt S of a user U, or may be attached to headband 28 that fits on a head H of the user. The battery pack 26 may likewise be attached to a user, such as to clothing or a belt, for example to a pocket P of the shirt S, or to a pocket R of the user's pants Q. In general, the battery pack 26 and the clamp 22 may be attached to a variety of items that may be worn by a user, referred to herein as "apparel."

Figure 4:
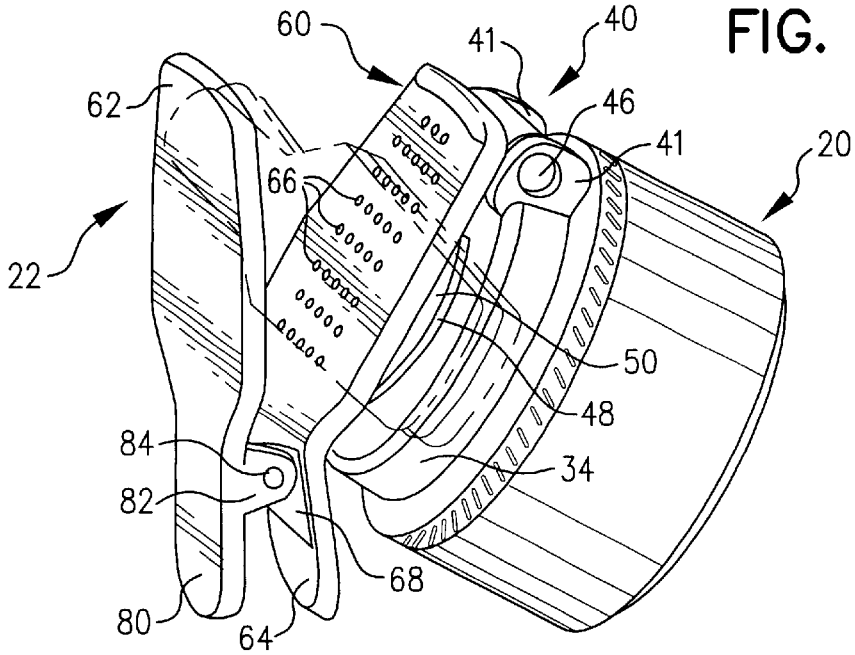
FIG. 4 is side, rear perspective view of the clamp and light of FIG. 2, with the clamp shown in an opened position.

Turning now to FIG. 2, the light 20 includes a circular lens 30 at the end of an outer, cylindrical shaped bezel 32. The bezel 32 is rotatably mounted on a light housing 34, the back of which is shown in FIG. 4. A rear portion 36 of the bezel 32 includes knurls 38 extending around its outer perimeter. Rotation of the bezel 32 relative to the light housing 34 (shown by the arrow in FIG. 2) turns on and off the light 20, and changes the focus of the light 20, for example by providing a narrow, focused beam when first turned on (i.e., at the beginning of rotation of the bezel 32), and a broad beam upon further rotation of the bezel. Such a mechanism is known in the art, and its details are not discussed in detail here. The knurls 38 provide a gripping surface so that the bezel 32 may be more easily grasped and turned.

As can be seen in FIG. 3, a hinge mount 40 is attached to one edge of the back side of the light housing 34. The hinge mount 40 includes a pair of hinge posts 41 (only one of which is shown, but the other of which is a mirror image of the shown post) that are generally square in shape, and includes a hinge pin 46 extending therethrough. A hinge plate 42 is attached to the pin 46, and includes an extension 44 that is attached to the pin 46, and a circular mounting plate 48. The hinge plate 42 can hinge outward from the light housing 34, as is generally shown in phantom in FIG. 3, and as is described further below.

A rotary base 50 is mounted for rotation on the circular mounting plate 48. The clamp 22 is mounted on the rotary base 50. Rotation of the rotary base 50 may be provided in any number of different ways known in the art. As one example, the rotary base 50 may be circular, and may fit into a circular slot in the circular mounting plate 48. If this arrangement is used, the rotary base 50 is slightly smaller in diameter than the circular slot, so that the rotary base may rotate within the circular slot. The inner sides of the circular slot and the outer sides of the rotary base 50 may be correspondingly tapered so that the mounting plate will not fall out of the circular slot. Alternatively, the rotary base 50 may include an inner bevel (not shown) that fits behind an inwardly-shaped bevel on the circular slot to keep the rotary base 50 within the circular slot.

Figure 7:
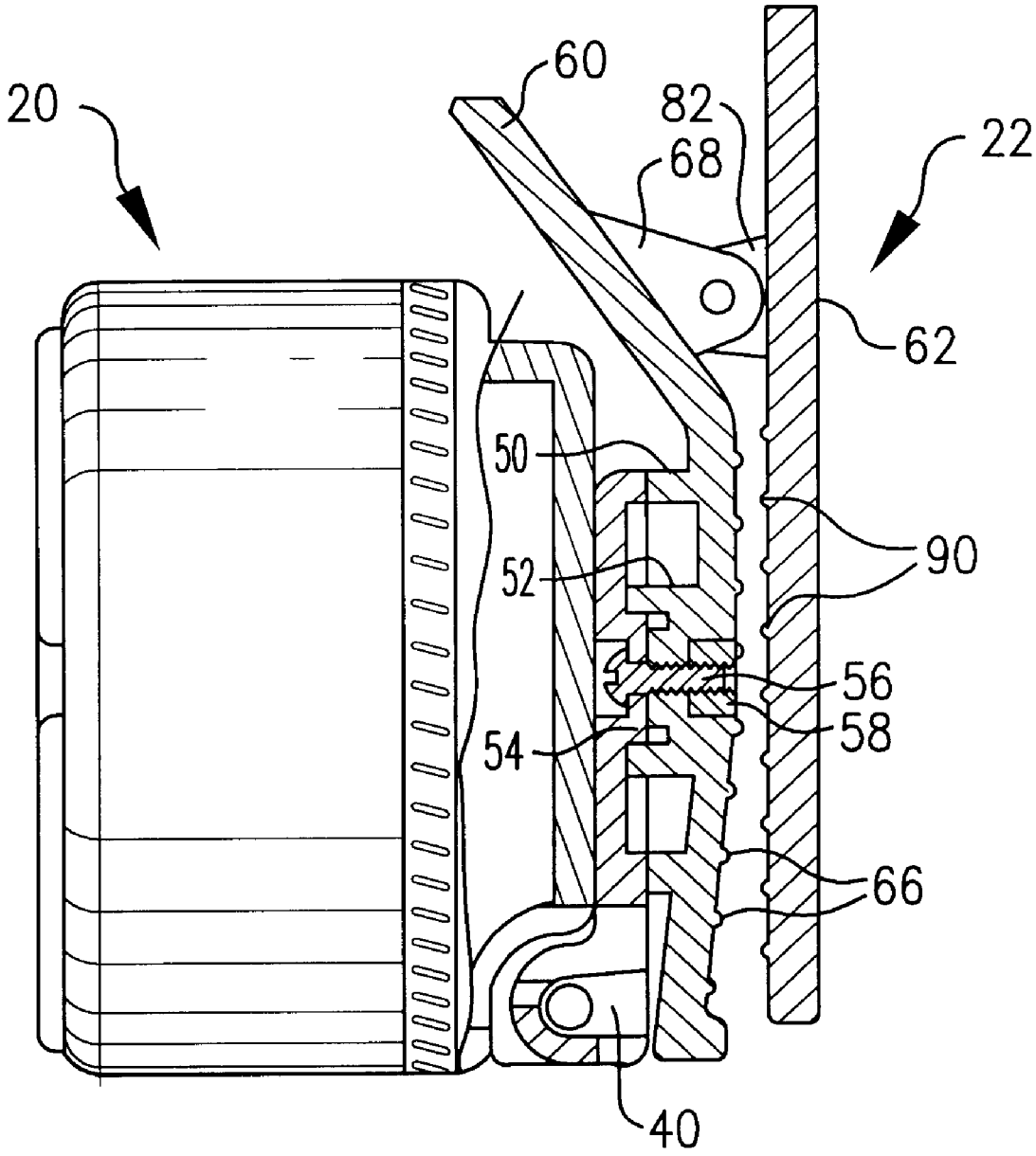
FIG. 7 is a side, partial sectional view of the clamp and light of FIG. 2.

One example of a rotary attachment is shown in FIG. 7, wherein a post 54 extends out of the central portion of the back of the circular mounting plate 48. A post 52 on the back of the rotary base 50 fits over the post 54 on the circular mounting plate 48. A screw 56 and nut 58 hold the two pieces together, and is tightened an amount that is sufficient to hold the two pieces together, but is loose enough to allow rotation of the clamp 22 relative the light 20. Other rotation mechanisms may be used.

The clamp 22 includes inner and outer arms 60, 62. The inner arm 60 is substantially flat along the majority of its length, and includes a forwardly-bent gripping portion 64. The gripping portion 64 is narrower in width than the flat portion of the inner arm 60. The inner side of the flat portion of the inner arm 60 is mounted on the circular-shaped mounting plate 50.

Rows of teeth 66 (FIG. 4) extend along the outer surface of the flat portion of the inner arm 60. The teeth 66 in one embodiment are round protrusions, and the rows are preferably spaced in a regular pattern, for example, in 5 millimeter increments. A triangular-shaped hinge mount 68 extends out of the gripping portion 64 of the inner arm 60.

The outer arm 62 of the clamp 22 is substantially flat along its length, and tapers at one end to a gripping portion 80. A triangular-shaped hinge mount 82 extends inward from the gripping portion 80, and is attached by a pin 84 to the triangular-shaped hinge mount 68 of the inner arm 60. The hinge mounts 68, 82 and the inner and outer arms 60, 62 are preferably arranged so that the gripping portions 64, 80 and the flat portions of the two arms are aligned opposite one another. As described further below, a spring 86 or another biasing device is provided to press the flat portions of the two arms together so as to press them firmly together.

The outer arm 62 also includes rows of teeth 90 along its inner surface. The teeth 90 are preferably spaced in a regular pattern that matches the spacing of the teeth 66 on the inner arm 60, for example in 5 millimeter increments. The teeth 90 on the outer arm 62 are preferably offset relative to the teeth 66 on the inner arm 60, so that rows of teeth 66 on the inner arm 60 are received between the rows of the teeth 90 of the outer arm 62 when the clamp 22 is in a closed position. The function of this feature is described below.

In use, the clamp 22 is gripped by the two gripping portions 64, 80, for example by the thumb and index finger of a user. Pressure is applied to the two gripping portions, against the bias of the spring 86. The inner and outer arms 60, 62 may then be arranged on opposite sides of a clamping surface, for example, an article of clothing, and the gripping portions may be gradually released. The bias of the spring 86 compresses the inner and outer arms 60, 62 of the clamp 22 against the clamping surface, and holds the clamp 22 and light 20 into position. The opposing, offset teeth 66, 90 help grip the clamping surface.

Although the teeth 66, 90 of the shown embodiment are round protrusions, the teeth may take other forms, such as jagged edges or other gripping contours. In addition, a clamp or other light holding mechanism may not include teeth.

Although the clamp 22 is shown as a spring-biased clip, different mechanisms may be used to grip the light 20 of the present invention on the apparel of a user. However, a light made in accordance with the present invention preferably is sturdily mountable on a user, so that the light may be focused on an object and maintains its illumination direction. To this end, the shape of the light 20 and the clamp 22 aid in stabilizing the light when it is attached to a user.

As can be seen, the clamp 22 is mounted close to the light 20, and in fact the clamp in one embodiment is spaced only ¼ inch away from the back of the light housing 34, and is spaced less than 2 inches from the front of the light. The light 20 is wide in comparison to its depth, for example, 2 3/16 inches compared to 1½ inches, and the clamping portions of the clamp 22 are preferably wide (1 13/16 inches) and long (1 13/16 inches). By providing a large clamping surface area, and a light housing with a broad base relative to its depth, the light 20 is very stable when clamped to clothing or other articles. To this end, it is preferred that the distance between the front end of the light 20 and the gripping portion of the clamp 22 (i.e., the intersection of the two arms 60, 62) be less than, or roughly the same as, the width of the light. These features stabilize the light, and minimize drooping, rocking, or sagging when the light 20 is attached to a user, and permit the light to maintain a relatively stable illumination direction.

As can be seen in FIG. 3, the hinge 40 permits the light 20 to rotate outward relative to the clamp 22. In one embodiment, the light 20 rotates 90 degrees relative to the clamp 22, but other amounts are within the spirit of the present invention. The rotational mounting of the clamp 22 relative to the hinge 40 permits the light 20 to be rotated outward from the clamp in a desired direction, permitting the light to illuminate in a wide variety of different angles. In this manner, after the light 20 is attached to a user, a user may manipulate the light toward a desired target, providing flexibility in illumination direction.

Figure 5:
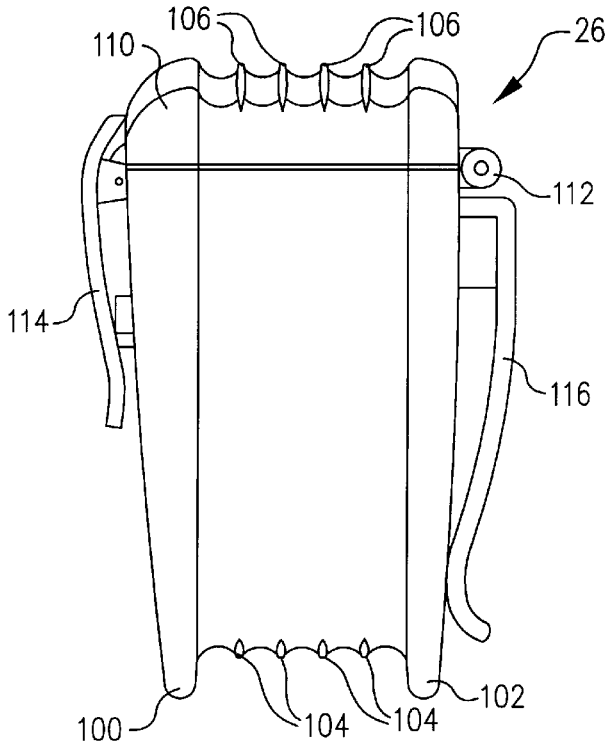
FIG. 5 is a side view of a battery pack that may be used with the light of the present invention.
Figure 6:
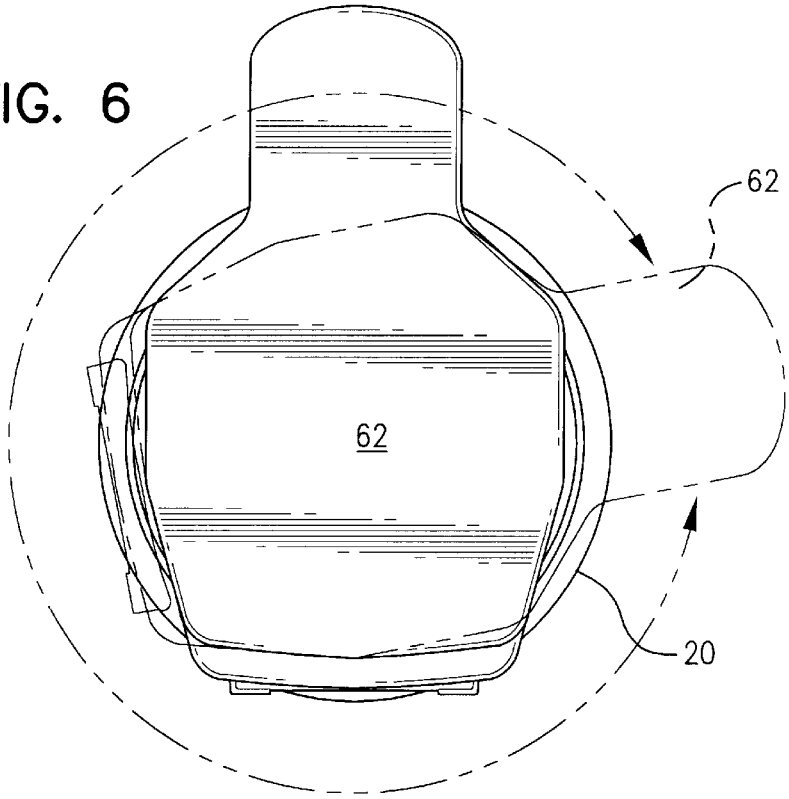
FIG. 6 is rear view of the clamp and light of FIG. 2.

A side view of the battery pack 26 is shown in FIG. 5. The battery pack 26 is generally rectangular in cross section, and includes a front lower flange 100 and a rear lower flange 102, both of which extend the width of the battery pack. A series of ridges 104 extend parallel to, and between, the front lower flange 100 and the rear lower flange 102, and a corresponding set of ridges 106 extend on the top side of the battery pack 26. The ridges 104, 106 form a cord wrap for the cord 24, and the front lower flange 100 and the rear lower flange 102 define outer walls for the cord wrap.

The battery pack 26 includes a top 110 that is attached by a hinge 112. A clip 114 holds the top in place, and may be bent outward to permit the top 110 to be hinged open. Batteries (not shown), such as two D sized batteries or the like, fit into the battery pack 26, and supply the power for the light 20 via the cord 24. The battery pack also includes a belt clip 116, formed of a flexible plastic or other suitable material, that may be bent outward to receive and fit onto an attachment surface, such as a belt, a pocket, or other suitable fastening locations.

If desired, the light 20 may be operated by an AC power adapter. However, by using the battery pack 26, the light 20 and its power source are fully portable. In addition, by providing the power supply separate from the light 20, the light is not as heavy as it would be if batteries were attached. This feature permits the light to remain lightweight, and facilitates its stable connection to a user as described above.

Details of the headband 28 are shown in FIG. 2. The headband 28 includes a clamp mount 120 having a slot 122 that extends vertically therethrough. The slot 122 is opened on a front side, so that two U-shaped ends 123 are formed at the ends of the slot. Rings are formed integrally with the clamp mount 120, so as to form left, right, and top strap connectors 124, 126, 128.

A side head strap 130 extends through the left strap connector 124 and is attached to itself by a strap loop 132. The side head strap 130 forms a loop, extends through the right strap connector 126, and is connected to itself by a second strap loop 134. A top head strap 136 extends through the top strap connector 128, and is attached to itself by a strap loop 138. The opposite end of the top head strap 136 is attached to the side head strap 130, for example by a loop (not shown, but the attachment of straps is known).

In use, the headband 28 is placed on the head H of a user U by extending the side head strap 130 around the user's head and adjusting the strap loops 132 and 134 so that the clamp mount 120 is centered on the user's forehead and the side head strap fits snugly around the user's head. The top head strap 136 is adjusted against the top of the head H to prevent the side straps from slipping down the user's head.

After the headband 28 is in place, the light 20 may be attached to the headband. Although the clamp 22 may be attached to any of the straps 130, 136, the clamp mount 120 provides a particularly stable mounting location for the light 20. To mount the light 20 on the clamp mount 120, a user grips the two gripping portions 64, 80, for example by the thumb and index finger of a user. Pressure is applied to the two gripping portions 64, 80, against the bias of the spring 86. The outer arm 62 is then inserted in the slot 122, and the gripping portions are released. The bias of the spring 86 causes the inner arm 60 to press against the outer housing of the clamp mount 120, and thereby holds the light 20 in position.

The mounting of the light 20 on the headband 28 provides a convenient, sturdy mechanism by which the light may be used in a hands-free mode. Using the hinge 40 and the rotational mount of the clamp 22 on the hinge, the light may be directed in multiple directions from the user's head, and may be held steadily in each of those directions.

The combination of the light 20 and the clamp 22 provided by the present invention offers many advantages. The clamp 22 may be attached to several different surfaces on a user, including but not limited to, clothing, belts, hats, and backpacks. The battery pack 26 permits the clamp and light combination to be transported during use. The pivoting and hinging connection between the light 20 and the clamp 22 permits the light to have freedom of movement in two different dimensions, providing illumination in a variety of different directions. The light 20 and clamp 22 may be clamped into the headband 28, which provides a stable base for the light, and permits the light to be aligned with a user's line of sight.

A variety of different mechanisms may be used to turn on and off the light 20, but rotation of the bezel 32 provides a convenient mechanism that does not require additional structures for power on or off functions. Preferably, the force that must be overcome to rotate the bezel 32 relative to the light housing 34 is substantially less than the force needed to rotate the rotary base 50 relative to the light housing. In this manner, when a user grips and rotates the bezel 32 (for example by gripping the knurls 38 and rotating the bezel), the light 20 turns on or off, or changes its focus, instead of the light housing rotating relative to the clamp 22. If a user desires that the light 20 be rotated relative to the clamp 22, the user may grasp the rear portion of the light housing 34 and rotate the light 20, or the user may grasp the bezel 32 and turn it beyond the turning motion permitted by the light housing 34. Either of these operations may be performed while the light 20 and clamp 22 are mounted on a user, or before they are mounted.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. A light structure, comprising:

a light;

a bezel rotatably mounted on the light;

a gripping mechanism attached to the light, the a gripping mechanism configured to grip apparel, the gripping mechanism being rotatably mounted relative to the light; and a switch connected with the light and the bezel wherein the light is turned on by rotation of the bezel relative to the light;

wherein a force required to rotate the bezel relative to the light is less than a force required to rotate the light relative to the gripping mechanism.

2. A light structure, comprising:

a gripping mechanism, the gripping mechanism configured to grip apparel, and the gripping mechanism defining a gripping location where apparel is gripped; and a light having a light emitting end and defining a width, the light being attached to the gripping mechanism by:

a rotary mount attached to the gripping mechanism that permits the light to be rotated relative to the gripping mechanism; and a pivot mount attached to the rotary mount and the light, and that permits the light to rotate outward relative to the rotary mount.

3. The light structure of claim 2, further comprising a headband comprising a mounting structure to which the gripping mechanism may be attached.

4. The light structure of claim 2, wherein the gripping mechanism comprises a pair of arms that are biased together by a spring.

5. The light structure of claim 4, wherein the mounting structure comprises a slot into which one of the arms may be inserted.

6. The light structure of claim 5, wherein the other arm closes, by bias of the spring, on the outside of the mounting structure to grip the light in position when the one arm is inserted in the slot.

7. The light structure of claim 4, wherein the arms include teeth along an inner surface.

8. The light structure of claim 7, wherein the teeth comprise rows of teeth, and wherein rows of teeth on one arm are offset relative to rows of teeth on the other arm.

9. The light structure of claim 2, further comprising a power supply located remote from the light and attached by a cord to the light.

10. The light structure of claim 9, wherein the power supply comprises a battery pack.

11. The light structure of claim 10, wherein the battery pack comprises a clip for attaching to apparel.

12. The light structure of claim 11, wherein the battery pack comprises a cord wrap about its outer perimeter.

13. The light structure of claim 1, wherein the pivot mount comprises a binge mounted between the light and the rotary mount.

14. The light structure of claim 13, wherein the hinge mount is configured to permit the light to rotate outward at least approximately 90 degrees.

15. The light structure of claim 2, wherein the light is configured so that it is turned on by rotation of a bezel on the outside of the light, and wherein a force required to rotate the bezel is less than a force required to rotate the light relative to the gripping mechanism.

16. The light structure of claim 2, wherein the width of the light is greater than, or substantially equal to, the distance between the light emitting end and the gripping location.

17. A light structure, comprising:

a gripping mechanism comprising a pair of arms that are biased together by a spring;

a light having a light emitting end and defining a width, the light being attached to the gripping mechanism; and a headband defining a mounting structure having a slot for receiving one of the arms of the gripping mechanism.

18. The light source of claim 17, wherein the light is attached to the gripping mechanism by:

a rotary mount attached to the gripping mechanism that permits the light to be rotated relative to the gripping mechanism; and a pivot mount attached to the rotary mount and the light, and that permits the light to rotate outward relative to the rotary mount.

19. The light structure of claim 17, wherein the arms include teeth along an inner surface.

20. The light structure of claim 19, wherein the teeth comprise rows of teeth, and wherein rows of teeth on one arm are offset relative to rows of teeth on the other arm.

21. The light structure of claim 17, further comprising a power supply located remote from the light and attached by a cord to the light.

22. The light structure of claim 21, wherein the power supply comprises a battery pack.

23. The light structure of claim 22, wherein the battery pack comprises a clip for attaching to apparel.

24. The light structure of claim 22, wherein the battery pack comprises a cord wrap about its outer perimeter.

25. The light structure of claim 17, wherein the light is rotatably attached to the gripping mechanism.

26. The light structure of claim 25, wherein the light is configured so that it is turned on by rotation of a bezel on the outside of the light, and wherein a force required to rotate the bezel is less than a force required to rotate the light relative to the gripping mechanism.

27. The light structure of claim 17, wherein the light is pivotally attached to the gripping mechanism.

* * * * *